US008646971B2

(12) United States Patent
Doyle

(10) Patent No.: US 8,646,971 B2
(45) Date of Patent: Feb. 11, 2014

(54) PORTABLE MAGNETIC POCKET

(75) Inventor: Sharon A. Doyle, Cedar Rapids, IA (US)

(73) Assignee: Pocket Plus, L.L.C., Cedar Rapids, IA (US)

( * ) Notice: Subject to any disclaimer, the term of this patent is extended or adjusted under 35 U.S.C. 154(b) by 1091 days.

(21) Appl. No.: 12/194,329

(22) Filed: Aug. 19, 2008

(65) Prior Publication Data

US 2009/0208148 A1 Aug. 20, 2009

Related U.S. Application Data

(60) Provisional application No. 61/028,971, filed on Feb. 15, 2008.

(51) Int. Cl.
*B65D 33/24* (2006.01)

(52) U.S. Cl.
USPC ..... 383/38; 383/86

(58) Field of Classification Search
USPC ..... 383/85, 11; 224/183; 446/242
See application file for complete search history.

(56) References Cited

U.S. PATENT DOCUMENTS

| | | | | |
|---|---|---|---|---|
| 1,310,125 | A | 7/1919 | Lundberg et al. | |
| 1,669,791 | A * | 5/1928 | Stocks | 383/85 |
| 3,051,130 | A * | 8/1962 | Morris | 224/183 |
| 3,611,444 | A | 10/1971 | Rector | |
| 3,747,776 | A | 7/1973 | Gross | |
| 4,236,331 | A | 12/1980 | Mattson | |
| 4,266,300 | A | 5/1981 | Partridge | |
| 4,651,355 | A | 3/1987 | White | |
| 5,054,127 | A | 10/1991 | Zevchak | |
| 5,063,614 | A | 11/1991 | McSheffery | |
| 5,170,889 | A * | 12/1992 | Cue | 206/232 |
| 5,351,813 | A | 10/1994 | Golovan | |
| 5,617,587 | A | 4/1997 | Marchbanks | |
| 5,682,648 | A | 11/1997 | Miller | |
| 5,870,777 | A | 2/1999 | Hans | |
| 5,946,732 | A | 9/1999 | Richards | |
| 6,000,103 | A | 12/1999 | Paice et al. | |
| 6,026,581 | A | 2/2000 | Gruetzmacher | |
| 6,035,449 | A | 3/2000 | Galler et al. | |
| 6,233,747 | B1 | 5/2001 | Barker | |
| 6,282,760 | B1 | 9/2001 | Mars | |
| 6,397,398 | B1 | 6/2002 | Herder | |
| 6,412,116 | B1 | 7/2002 | Clark | |
| 6,434,801 | B2 | 8/2002 | Grunberger | |
| 6,571,997 | B2 | 6/2003 | Dedrick | |
| 6,796,344 | B2 * | 9/2004 | Chen et al. | 150/113 |
| 6,839,917 | B1 | 1/2005 | Landwehr | |
| 7,114,190 | B2 | 10/2006 | Najarian et al. | |
| 2002/0095751 | A1 | 7/2002 | Reiter | |
| 2002/0135178 | A1 | 9/2002 | Rzadzki | |
| 2007/0051729 | A1 | 3/2007 | Osborne | |
| 2007/0151084 | A1 | 7/2007 | Long | |
| 2007/0186390 | A1 | 8/2007 | Johnston | |
| 2007/0214613 | A1 | 9/2007 | Shiao | |
| 2008/0025652 | A1 * | 1/2008 | Hendricks | 383/84 |

* cited by examiner

*Primary Examiner* — Gary Elkins
*Assistant Examiner* — Christopher Demeree
(74) *Attorney, Agent, or Firm* — Zarley Law Firm, P.L.C.

(57) ABSTRACT

A portable bag having a first layer of fabric and a second layer of fabric that are attached at outer edges to form a first hollow chamber. The layers of fabric are folded to form a first pocket and a second pocket. The first pocket is folded to form a flap. Magnets are inserted within the first pocket and the flap such that the magnets align when the flap is folded over the first pocket.

6 Claims, 2 Drawing Sheets

PORTABLE MAGNETIC POCKET

CROSS REFERENCE TO RELATED APPLICATION

This application claims the benefit of U.S. Provisional Application No. 61/028,971 filed Feb. 15, 2008.

BACKGROUND OF THE INVENTION

The present invention is directed to a portable pocket or bag and more specifically to a portable pocket that uses magnets for attachment.

Portable bags are well known in the art. There are a number of ways to attach the bags such as strings, snaps, and Velcro®. While attachment is possible, either the attachment is not secure or it is time consuming to attach. Therefore, a need exists in the art for a portable pocket or bag that addresses these deficiencies.

An objective of the present invention is to provide a portable bag that is less time consuming to attach.

Another objective of the present invention is to provide a portable bag that provides a quick and secure attachment.

These and other objectives will be apparent to those of ordinary skill in the art based upon the following written description.

BRIEF SUMMARY OF THE INVENTION

A portable bag having a first layer of fabric and a second layer of fabric that are attached at the edges to form a hollow chamber. The first and second layers are folded and attached along a bottom edge to form a first and second pocket. A support member is inserted within a portion of the first pocket and an encasement secures a first magnet. The first pocket is folded to form a flap. Secured within the flap is a second magnet that is positioned to align with the first magnet when the flap is folded over the first pocket.

DETAILED DESCRIPTION OF THE PREFERRED EMBODIMENT

Figure 1:
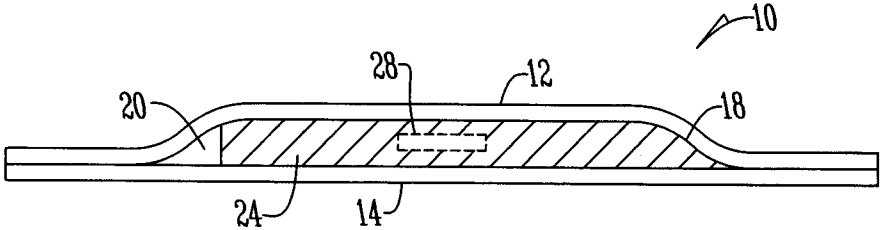
FIG. 1 is an end perspective view of a bag.
Figure 2:
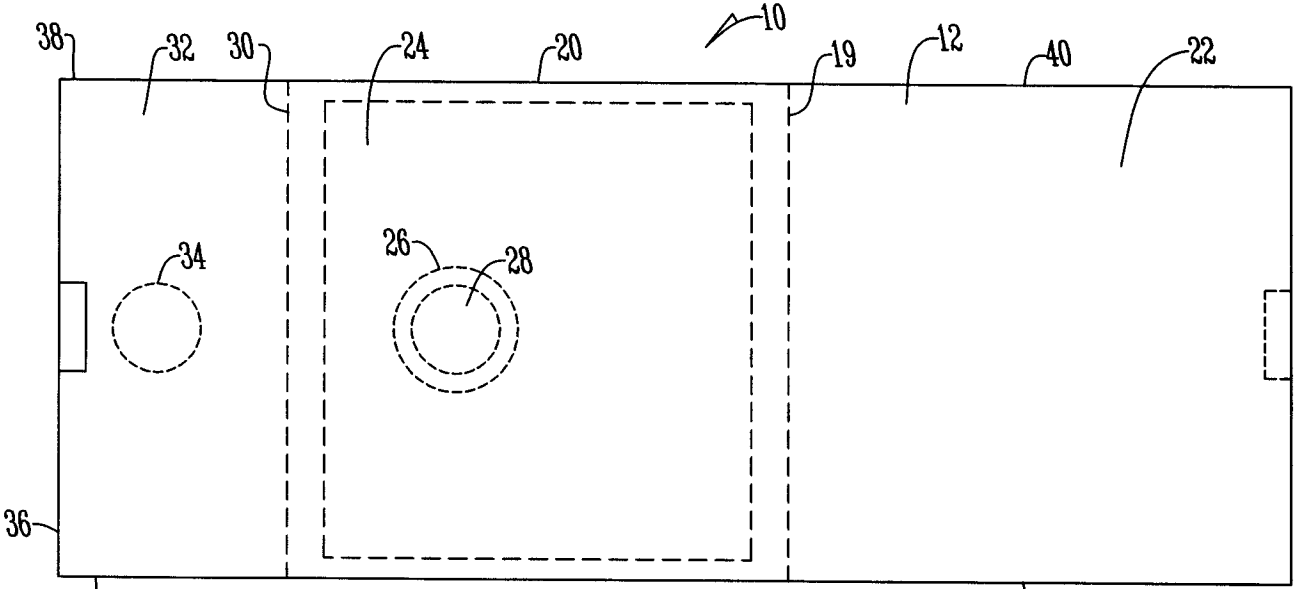
FIG. 2 is a side plan view of a bag.
Figure 3:
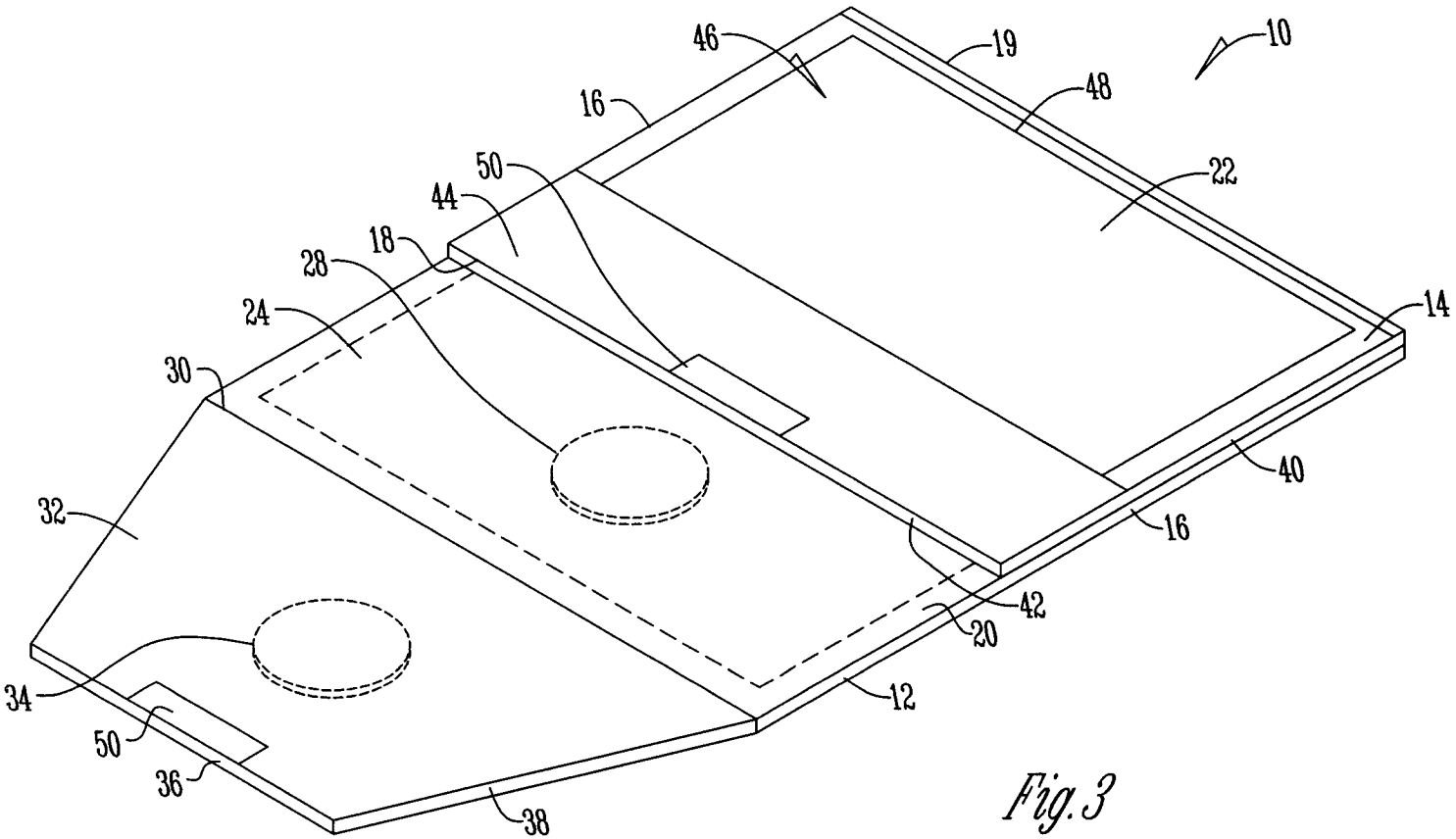
FIG. 3 is a perspective view of a bag.

Referring to the figures, a portable bag 10 has a first layer of fabric 12 and a second layer fabric 14 that are attached at the outer edges 16 to form a hollow chamber 18. Alternatively, a single piece of fabric is folded over to form a first layer 12 and second layer 14 attached at the outer edges 16 to form a hollow chamber 18. The first layer 12 and second layer 14 are folded along line 19 to form a first pocket 20 and a second pocket 22. Stitching is provided along line 19 to form a bottom edge of bag 10 and seal the bottom of the pockets 20 and 22.

Inserted within a portion of the first pocket 20 is a support member 24 that has an opening 26 that receives a high powered magnet 28 such as an earth magnet. Alternatively, a casement is sewn within the pocket 20 to hold the magnet 28. The first pocket is then folded and stitched along line 30 to seal the support member 24 within the first pocket 20 and form a flap 32.

Inserted within the flap 32 is a second magnet 34 that is positioned such that it aligns with magnet 28 when the flap 32 is folded over the first pocket 20. The flap 32 is stitched at its end 36 and side 38 to contain the magnet 34 which is also a high powered magnet such as an earth magnet.

The second pocket 22 is stitched along its edges 40 to secure the second pocket 22 to the first pocket 20 and form a chamber 42 between the first pocket 20 and the second pocket 22. the top edge 44 remains open to permit access to chamber 42 and the hollow chamber of the second pocket 22. Additional pockets 46 are added by stitching a third layer 48 of fabric to the outer surface of the second pocket 22 along the bottom and side edges.

Attached to the end 36 of the flap 32 and the top edge 44 of the second pocket 22 is a fastening member 50 to releasably secure the flap 32 to the pocket 22. The fastening member is of any type and preferably is a hook and loop arrangement.

In an alternative embodiment, a first pocket 20 is formed by connecting a first layer of fabric 12 to a second layer 14 of fabric at the edges 16 to form a hollow chamber 18. A support member 24 along with a magnet 28 are inserted and sealed within the first pocket 20. Additional pockets are formed by stitching a separate layer of fabric along the bottom edge and side edges of the first pocket. The pockets may also be sealed by a fastening element 50 attached to the inner surface of one pocket and the outer surface of the adjacent pocket. A flap 32 containing a second magnet is attached to the first pocket such that the second magnet aligns with the first magnet when the flap is folded over the first pocket.

Therefore, a portable bag has been disclosed that at the very least meets the stated objectives.

What is claimed is:

1. A portable bag comprising:

a first layer of fabric and second layer of fabric attached along outer edges to form a hollow chamber;

wherein the first layer of fabric and the second layer of fabric are folded to form a first pocket and a second pocket and a bottom edge sealing the first pocket to the second pocket;

wherein edges of the second pocket are secured to the first pocket such that a chamber is formed between the first pocket and the second pocket;

wherein a top edge of the second pocket is open to permit access to the chamber between the first pocket and the second pocket and a hollow chamber of the second pocket;

a support member inserted into the first pocket and having an opening that receives a first magnet enclosed within a casement in the first pocket;

the first pocket being stitched and folded to form a flap such that a second magnet secured within the flap is positioned to align with the first magnet within the first pocket when the flap is positioned over the first pocket.

2. The bag of claim 1 further comprising a fastening element attached to the flap and the second pocket.

3. The bag of claim 1 further comprising a third layer of fabric attached to the second pocket.

4. The bag of claim 1 further comprising a first fastening member attached to an end of the flap and a second fastening member attached to a top edge of the second pocket such that the end of the flap is releasably secured to the top edge of the second pocket when the flap is folded over the first pocket.

5. A portable bag comprising:

a first layer of fabric and second layer of fabric attached along outer edges to form a hollow chamber;

wherein the first layer of fabric and the second layer of fabric are folded to form a first pocket and a second pocket and a bottom edge sealing the first pocket to the second pocket;

a support member inserted into the first pocket and having an opening that receives a first magnet enclosed within a casement in the first pocket;

the first pocket being stitched and folded to form a flap such that a second magnet secured within the flap is positioned to align with the first magnet within the first pocket when the flap is positioned over the first pocket;

wherein edges of the second pocket are secured to the first pocket such that a chamber is formed between the first pocket and the second pocket; and wherein a top edge of the second pocket is open to permit access to the chamber between the first pocket and the second pocket and a hollow chamber of the second pocket.

6. The bag of claim 5 further comprising a first fastening member attached to an end of the flap and a second fastening member attached to a top edge of the second pocket such that the end of the flap is releasably secured to the top edge of the second pocket when the flap is folded over the first pocket.

* * * * *